US005417347A

United States Patent [19]

de LaForcade

[11] Patent Number: 5,417,347

[45] Date of Patent: May 23, 1995

[54] DISPENSER FOR LIQUID OR PASTE

[75] Inventor: Vincent de LaForcade, Clamart, France

[73] Assignee: L'Oreal, Paris, France

[21] Appl. No.: 193,176

[22] PCT Filed: Aug. 20, 1992

[86] PCT No.: PCT/FR92/00810

§ 371 Date: Feb. 10, 1994

§ 102(e) Date: Feb. 10, 1994

[87] PCT Pub. No.: WO93/03858

PCT Pub. Date: Mar. 4, 1993

[30] Foreign Application Priority Data

Aug. 23, 1991 [FR] France ..... 91 10576

[51] Int. Cl.[6] ..... B65D 35/28

[52] U.S. Cl. ..... 222/95; 222/105; 222/209; 222/494

[58] Field of Search ..... 222/95, 209, 210, 214, 222/386.5, 105, 212, 490, 494

[56] References Cited

U.S. PATENT DOCUMENTS

| | | | |
|---|---|---|---|
| 2,608,320 | 8/1952 | Harrison, Jr. | 222/95 |
| 2,743,038 | 4/1956 | Ferries | 222/95 |
| 2,777,612 | 1/1957 | Bensen | 222/386.5 X |
| 2,804,995 | 9/1957 | Fee | 222/386.5 X |
| 3,195,785 | 7/1965 | Oram | 222/212 X |
| 3,223,289 | 12/1965 | Bouet | 222/209 |
| 3,255,933 | 6/1966 | Martin | 222/209 |
| 3,341,083 | 9/1967 | Stewart | 222/209 |
| 3,794,247 | 2/1974 | Corsette | 222/211 |
| 4,087,024 | 5/1978 | Martin et al. | 222/211 |
| 4,147,278 | 4/1979 | Uhlig | 222/95 X |
| 4,159,790 | 7/1979 | Bailey | 222/211 |
| 4,909,416 | 3/1990 | Evezich | 222/95 |
| 5,005,737 | 4/1991 | Rohr | 222/212 |
| 5,012,956 | 5/1991 | Stoody | 222/95 X |

FOREIGN PATENT DOCUMENTS

| | | | |
|---|---|---|---|
| 1316596 | 12/1961 | France | 222/95 |
| 2389419 | 12/1978 | France . | |
| 1034053 | 7/1958 | Germany | 222/214 |
| 0254561 | 10/1989 | Japan | 222/212 |

*Primary Examiner*—Andres Kashnikow
*Assistant Examiner*—Lisa Douglas
*Attorney, Agent, or Firm*—Young & Thompson

[57] ABSTRACT

The dispenser comprises a flexible bag (2) containing a liquid or paste (6) and housed in a container (5) having a rigid wall (53) with an elastic bellows (51), a handle (43) and a closure system (3) which opens or closes when the product (6) is not at an adequate pressure. By pressing on the handle (43), the air trapped between the container (5) and the flexible bag (2) exerts adequate pressure on the product (6). The dispenser also comprises a cap (42). The dispenser neck (41) is connected by film hinges (48, 49) to both the handle (43) and the cap (42).

7 Claims, 2 Drawing Sheets

DISPENSER FOR LIQUID OR PASTE

FIELD OF THE INVENTION

The present invention relates to a dispenser assembly for delivering a liquid or pasty product contained in a flexible bag having an automatic closure system which opens or closes, in order to deliver the product without taking in air, according to whether the product is or is not, through the flexible bag, at an adequate pressure, the flexible bag being, apart from its automatic closure system, contained in a leaktight manner in a container, the casing of which has a passage which can be closed off in order, in the event of closure of the passage which can be closed off, to be able to compress the air then trapped between the bag and the container, and thus to uniformly compress the bag in order to deliver the product.

Such a dispenser assembly has the advantage that it can be maneuvered with just one hand and that the product is protected against contamination from the environment, for example: dust or sand in the event that the container falls to the ground, water if it falls in the bathtub or in the sea, or, finally, the air, which oxidizes the products and prevents optimum preservation with minimum concentrations of chemical preservatives.

PRIOR ART

FR-A-2,389,419 describes a dispenser assembly in which the casing of the container is elastically deformable throughout; moreover, provision is made for the passage which can be closed off, of the casing, to be closed off by the finger of the user whose hand holds the casing in order to exert directly thereon the pressure necessary to deliver the product. This arrangement thus obliges the user to take care to position a finger opposite the passage which can be closed off. Moreover, the quantity of product delivered depends essentially on the force exerted by the user's hand and may even, accidentally, be quite excessive.

SUMMARY OF THE INVENTION

The object of the present invention, in particular, is to remedy these drawbacks and it proposes, in a particularly economical manner, to equip the dispenser assembly with a device arranged in order to deliver substantially the same quantity of product regardless of how the user's fingers make the maneuver.

The subject of the present invention is thus, firstly, a dispenser assembly as defined above, wherein the casing of the container comprises an element in the form of a bellows, which bellows is the only elastically deformable part of the casing of the container, the other walls of which are relatively rigid. A bellows is a known device and it is known that, upon each maneuver, it compresses the quantity of air present in the container and permits the delivery of a quantity of product; at the end of each maneuver, in order to deliver more product, it is obviously necessary to reset the bellows and, thus, there is no longer any risk of excess product flowing out; it even suffices to dimension the bellows adequately so as to obtain only the desired quantity of product and thus the dispenser assembly also acts as a metering device.

The dispenser assembly preferably also comprises a handle articulated so as to be manually maneuverable in order to compress the bellows. In fact, a bellows is a relatively fragile member and, in order to prevent premature wear of it, caused by rough handling, for example off-center maneuvers, it is preferable to impose on the user a single maneuvering direction by means of a handle articulated about a hinge.

The dispenser assembly is advantageously defined in that the said passage which can be closed off is provided on the outer wall of the bellows, and in that the said handle has, internally, opposite the passage which can be closed off, an element in relief arranged in order to close off the passage which can be closed off upon maneuvering of the handle. Thus, closure of the passage which can be closed off in order to trap the air is effected automatically and the user no longer has to take care in positioning his finger opposite the passage.

Various closing-off elements in relief can be envisaged but, advantageously, provision is made in the handle for a boss in the shape of a crown for application around the passage which can be closed off.

There are various known automatic closure systems for the flexible bag but, advantageously, provision may be made for a dome which has a slot and a body of general frustoconical shape which bears on the dome in order to keep the slot closed in the absence of sufficient pressure on the product, the dome being assembled in a leaktight manner on the flexible bag. Such a system has already been proposed, for example in U.S. Pat. No. 1,935,089.

Advantageously, the container has a neck comprising an annular bearing face and a snap-fit collar, the flexible bag and the dome each comprise a collar, and the frustoconical body comprises an annular bearing face and a snap-fit ring, the whole being arranged in order, by means of snap fitting, to produce a leaktight assembly of the dome on the flexible bag. The dispenser assembly thus produced is particularly economical since each of its elements can be molded, and they can be assembled together by simple snap-fitting.

Provision may also be made for the dispenser assembly also to comprise a safety closure cap articulated about a film hinge provided on the frustoconical body in order to cap the dome; similarly, provision may be made for the handle to be articulated about a film hinge provided on the frustoconical body; it is known, in fact, that some plastics lend themselves particularly well to forming hinges by providing a thickness which is thin enough at the desired location. Thus, the frustoconical body, the articulated handle and the articulated cap constitute one and the same molded piece. The result is that the dispenser assembly according to the invention is not only very economical owing to its method of manufacture, but can also be easily maneuvered by the user; it protects the product against contamination from the environment and, finally, it delivers the prescribed dose at the time of each maneuver.

In order to make the subject of the present invention more easily understood, a description will now be given below, by way of purely illustrative and non-limiting example, of an embodiment shown in the appended drawing.

DESCRIPTION OF THE PREFERRED EMBODIMENT

Figures 1, 2:
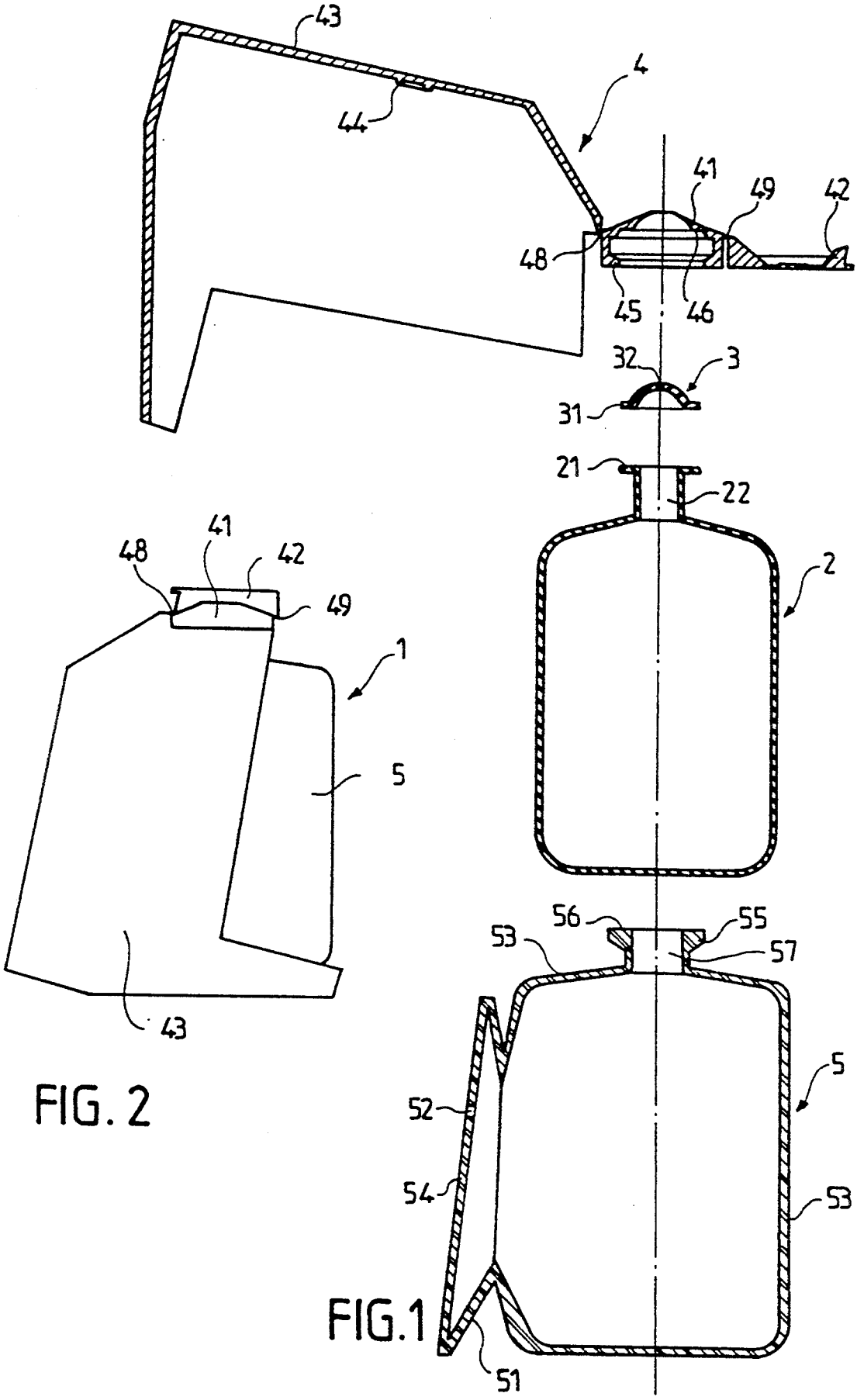
FIG. 1 is an exploded sectional view of the component elements of a dispenser assembly according to the invention.
FIG. 2 is an external view of the dispenser assembly obtained after mounting the elements in FIG. 1.

The exploded view in FIG. 1 shows a container 5, a flexible bag 2, a dome 3 and an activator 4; all these elements can be molded, for example in plastic.

The activator 4 comprises three principle parts, a handle 43, a body 41 and a cap 42; these three parts are connected by articulations 48, 49, for example flexible film hinges.

The body 41 is of cylindrical general shape ending in a frustoconical part on the upper side; the substantially cylindrical part comprises on the inside an annular bearing face 46 and, in its lower part, a snap-fit ring 45.

The cap 42, articulated about the flexible hinge 49, has a general frustoconical shape corresponding to that of the body 41 in order to cap it when the cap 42 tilts above the body 41.

The handle 43 which can pivot downwards about the articulation 48 has a general U shape, open towards the bottom; the central part of the U has on the inside a boss 44 in the shape of an annular crown.

It can be seen that the activator 4 is able to constitute only a single molded piece; in fact, only the snap-fit ring 45 can present a demolding problem but, in this case, provision may be made for it to be provided with radial slots in order to make it more flexible.

The dome 3 has a general nipple shape provided with a dispensing slot 32 and an annular collar 31.

The flexible bag 2, intended to contain the product, may have any general shape, but preferably a cylindrical shape; the flexible bag 2 comprises only one opening 22 having an annular collar 21.

The container 5 has a general cylindrical or parallelepipedal shape, the walls 53 of which are relatively rigid; a face of the container 5 has a bellows 51, the maneuverable wall 54 of which comprises a passage 52 which can be closed off, for example a small cylindrical opening; the bellows 51 which connects the wall 54 to the walls 53 in a leaktight manner obviously has the flexibility required for maneuvering the bellows; the container 5 has a neck 57 which ends in an annular bearing face 56 under which a snap-fit collar 55 is provided.

The snap-fit collar 55 of the container 5 and the snap-fit ring 45 of the activator 4 are arranged so as to snap-fit over each other, trapping the two respective annular collars 21, 31 of the flexible bag 2 and of the dome 3 in a leaktight manner between the annular bearing face 56 of the container 5 and the annular bearing face 46 of the activator 4.

Mounting of the dispenser assembly is effected as follows: introduction of the flexible bag 2 into the container 5 through its neck 57 by applying the annular collar 21 of the flexible bag 2 on the annular bearing face 56 of the container 5, filling of the flexible bag 2 with the product to be dispensed, positioning of the dome on the annular collar 21 of the flexible bag 2, and, finally, snap-fitting of the body 41 of the activator 4 in order to obtain the completed dispenser assembly. The handle 43 of the activator 4 is clearly arranged in order to be able to be folded down by pivoting about the hinge 48 and thus coming to surround the container 5, the boss 44 being positioned so as to be located opposite the passage 52 which can be closed off.

FIG. 2 is an exterior view of the dispenser assembly thus obtained. It can be seen, there, that the container 5 is partially concealed by the handle 43 articulated on the body 41 by means of the flexible hinge 48; the cap 42, articulated about the flexible hinge 49, is, here, represented in the closed position.

Figure 3A:
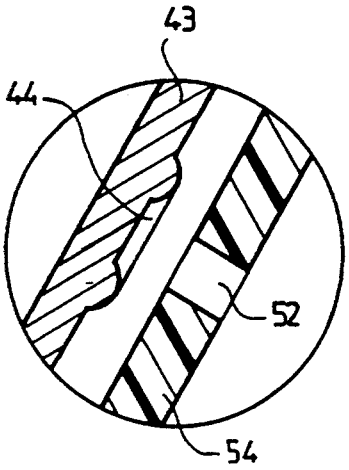
FIG. 3, with its detail at FIG. 3*a*, shows the same dispenser assembly as in FIG. 2, but ready for use and seen in section.
Figure 3:
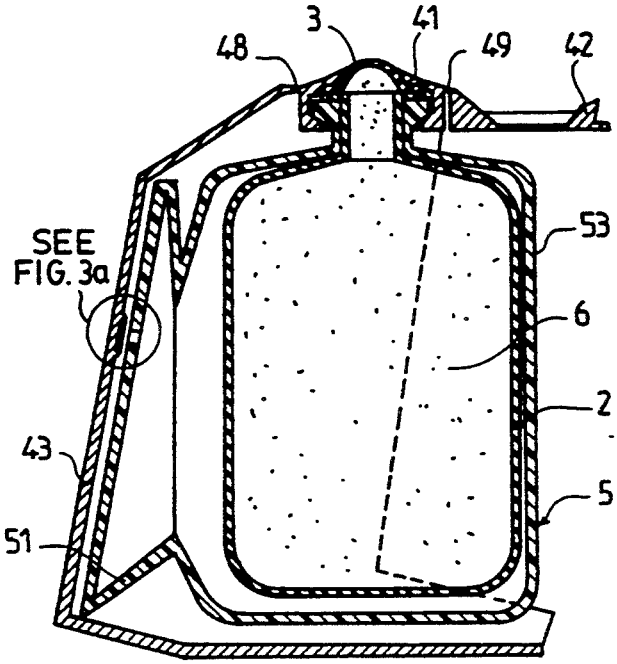

FIG. 3 is a sectional view of the dispenser assembly in FIG. 2, but, this time, with the cap 42 having pivoted through 180° about the hinge 49 in order to be located in the open position so that the dispenser assembly is ready for use. This figure shows the product 6 to be dispensed contained in the flexible bag 2 which is closed by the dome 3; the body 41 is in the snap-fit position over the container 5 and the handle 43 which can pivot about the articulation 48 is in the ready-for-use position.

The bellows 51, consisting of an elastic material, is, here, shown in its rest position. The general principle of operation of a bellows is known; here, it will be used to compress the air located between the container 5 and the bag 2. The detail of FIG. 3*a* shows the passage 52 which can be closed off which constitutes the air intake of the bellows provided in the wall 54 of the container 5; opposite this passage which can be closed off, provision is made, on the handle 43, for the element 44 in relief intended to close off the air intake of the bellows; here, the element 44 in relief is an annular boss in the shape of a crown centered over the passage.

Figure 4A:
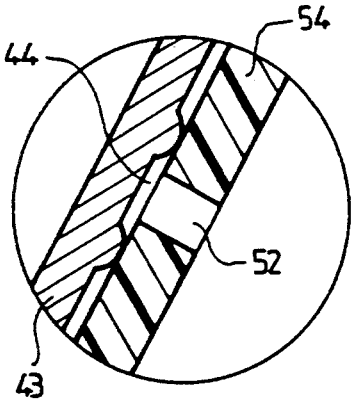
FIG. 4, with its detail at FIG. 4*a*, again shows, in section, the same dispenser assembly, but during use.
Figure 4:
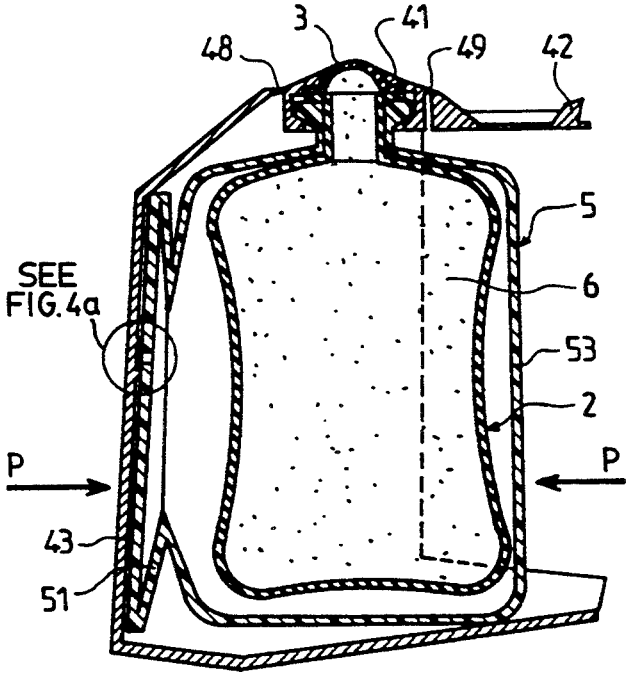

FIG. 4, with the detail at FIG. 4*a*, explains the method of operation of the dispenser assembly.

When a force P is exerted to bring the handle 43 closer to the container 5, the crown 44 of the handle 43 firstly caps the passage 52 of the wall 54 so that the air located between the container 5 and the flexible container 2 is trapped. The pressure of the air thus trapped therefore increases through the action of the bellows 51 compressed by the force P acting on the handle 43. This increase in pressure acts on the flexible container 2 so that the product 6 is subjected to adequate pressure to make it emerge via the slot in the dome 3.

When the force P ceases, the handle 43 moves away so that the air can again penetrate through the passage 52, between the container 5 and the bag 2, as the bellows 51 resumes its initial position owing to its elasticity. As the dome 3 is provided with a slot capable of delivering the product 6 without taking in air, the flexible bag 2 preserves the shape and the volume it attained at the end of the maneuver.

This method of operation is clearly repetitive so that the volume of the flexible bag 2 is progressively reduced as a function of the quantity of product delivered at the time of each maneuver.

I claim:

1. A dispenser assembly for delivering a liquid or pasty product, comprising:

—a flexible bag containing said product, said bag having an automatic closure system which opens or closes, in order to deliver the product without taking in air;

—a container having a casing made up of rigid walls and an elastically deformable bellows, said flexible bag being, apart from its closure system, contained in a leaktight manner in said container, said bellows having on an outer wall thereof, a passage which can be closed off in order to be able to compress air trapped between the bag and the container, and thus to uniformly compress the bag in order to deliver said product; and —a handle articulated so as to be manually maneuverable in order to compress the bellows, and having internally opposite the passage, an element in relief arranged to close off the passage upon maneuvering of the handle.

2. The dispenser assembly as claimed in claim 1, wherein the element in relief is a boss in the shape of a crown.

3. The dispenser assembly as claimed in claim 1, wherein the automatic closure system of the flexible bag comprises a dome which has a slot and a body of general frustoconical shape which bears on the dome in order to keep the slot closed in the absence of sufficient pressure on the product, said dome being assembled in a leaktight manner on the flexible bag.

4. The dispenser assembly as claimed in claim 3, wherein the container has a neck comprising an annular bearing face and a snap-fit collar, said flexible bag and said dome each comprising a collar, and said frustoconical body comprising an annular bearing face and a snap-fit ring, the whole being arranged in order, by means of snap fitting, to produce a leaktight assembly of the dome on the flexible bag.

5. The dispenser assembly as claimed in claim 4, further comprising a safety closure cap articulated about a film hinge provided on the frustoconical body in order to cap the dome.

6. The dispenser assembly as claimed in claim 4, wherein the handle is articulated about a film hinge provided on the frustoconical body.

7. The dispenser assembly as claimed in claim 5, wherein the frustoconical body, the articulated handle and the articulated cap constitute one and the same molded piece.

* * * * *